US005478606A

United States Patent [19]

Ohkuma et al.

[11] Patent Number: 5,478,606

[45] Date of Patent: Dec. 26, 1995

[54] METHOD OF MANUFACTURING INK JET RECORDING HEAD

[75] Inventors: Norio Ohkuma; Masashi Miyagawa; Genji Inada, all of Yokohama; Hiroaki Toshima, Tokyo; Tamaki Sato, Yokohama, all of Japan

[73] Assignee: Canon Kabushiki Kaisha, Tokyo, Japan

[21] Appl. No.: 392,686

[22] Filed: Feb. 23, 1995

Related U.S. Application Data

[63] Continuation of Ser. No. 190,464, Feb. 2, 1994, abandoned.

[30] Foreign Application Priority Data

Feb. 3, 1993 [JP] Japan ..... 5-016238
Jan. 31, 1994 [JP] Japan ..... 6-010078

[51] Int. Cl.[6] ..... B05D 3/06; B44C 1/22

[52] U.S. Cl. ..... 427/555; 216/27; 216/41; 216/67; 347/20; 347/45; 427/240; 427/386; 430/286; 430/320; 430/324

[58] Field of Search ..... 216/27, 41, 67; 347/20, 45; 427/240, 386, 555; 430/286, 320, 324

[56] References Cited

U.S. PATENT DOCUMENTS

| | | | |
|---|---|---|---|
| 4,730,197 | 3/1988 | Raman et al. | 346/140 R |
| 4,970,532 | 11/1990 | Komuro et al. | 346/140 R |
| 5,030,317 | 7/1991 | Noguchi | 156/630 |
| 5,043,747 | 8/1991 | Ebisawa et al. | 549/559 X |
| 5,086,307 | 2/1992 | Noguchi et al. | 346/140 R |
| 5,136,310 | 8/1992 | Drews | 346/140 R |
| 5,148,193 | 9/1992 | Inamoto et al. | 427/256 X |
| 5,157,418 | 10/1992 | Tamura | 346/140 R |
| 5,204,689 | 4/1993 | Shinato et al. | 346/1.1 |
| 5,208,604 | 5/1993 | Watanabe et al. | 346/1.1 |
| 5,290,667 | 3/1994 | Shiba et al. | 430/328 |

FOREIGN PATENT DOCUMENTS

| | | |
|---|---|---|
| 57-208255 | 12/1982 | Japan . |
| 57-208256 | 12/1982 | Japan . |
| 58-8658 | 1/1983 | Japan . |
| 60-161973 | 8/1985 | Japan . |
| 61-154947 | 7/1986 | Japan . |
| 62-264975 | 11/1987 | Japan . |
| 63-221121 | 9/1988 | Japan . |
| 64-9216 | 1/1989 | Japan . |
| 2-140219 | 5/1990 | Japan . |
| 4-10940 | 1/1992 | Japan . |
| 4-10941 | 1/1992 | Japan . |
| 4-10942 | 1/1992 | Japan . |
| 5-330066 | 12/1993 | Japan . |

OTHER PUBLICATIONS

Budavari, S. ed. "The Merck Index" (1989), cover, p. 1204.
Aldrich Chemical Co. Catalog (1992), title page, p. 982.
Crivello and Lam, "New Photoinitiators for Cationic Polymerization", J. Polymer Sci.: Polymer Symposia, Fourth Int'l Symposium on Cationic Polymerization, Symposium No. 56, pp. 383–395, John Wiley & Sons (1976).

*Primary Examiner*—Michael Lusignan
*Attorney, Agent, or Firm*—Fitzpatrick, Cella, Harper & Scinto

[57] ABSTRACT

A method of manufacturing an ink jet recording head, having the steps of forming an ink flow path pattern on a substrate with the use of a dissoluble resin, the substrate having ink ejection pressure generating elements thereon, forming on the ink flow path pattern a coating resin layer, which will serve as ink flow path walls, by dissolving in a solvent a coating resin containing an epoxy resin which is solid at ordinary temperatures, and then solvent-coating the solution on the ink flow path pattern, forming ink ejection outlets in the coating resin layer above the ink ejection pressure generating elements, and dissolving the ink flow path pattern.

46 Claims, 3 Drawing Sheets

METHOD OF MANUFACTURING INK JET RECORDING HEAD

This application is a continuation of application Ser. No. 08/190,464 filed Feb. 2, 1994, now abandoned.

BACKGROUND OF THE INVENTION

1. Field of the Invention

The present invention relates to a method of manufacturing an ink jet recording head for generating droplets of a recording liquid for use in the ink jet recording process.

2. Description of the Prior Art

An ink jet recording head used in the ink jet recording process generally comprises outlets for ejecting tiny drops of a recording liquid (hereinafter called orifices), a liquid flow path, and liquid ejection energy generating portions provided in a part of the liquid flow path. To obtain high grade images by such an ink jet recording head, it is desirable that droplets of recording liquid be ejected from the respective orifices always in the same volumes at the same speeds. To fulfill this condition, Japanese Patent Application Laid-open Nos. 10940/1992 to 10942/1992 disclose methods comprising applying driving signals to ink ejection pressure generating elements (electro-thermal conversion elements) in response to recorded information to cause the electro-thermal conversion elements to generate heat energy inducing a rapid temperature increase surpassing the nucleate boiling of the ink, thereby forming bubble in the ink, and ejecting ink droplets through the communication of the bubble with the atmosphere.

The ink jet recording head for accomplishing the above methods preferably provides a shorter distance between the electro-thermal conversion element and the orifice (hereinafter called the OH distance). In the above method, it is necessary that the OH distance can be set accurately and with good reproducibility, since this parameter virtually determines the ejection volume.

Conventional methods of manufacturing ink jet recording heads include a method as described in Japanese Patent Application Laid-open Nos. 208255/1982 to 208256/1982 which comprises pattern-forming a nozzle comprising ink flow paths and orifice portions on a substrate with the use of a photosensitive resin material, the substrate having ink ejection pressure generating elements thereon, and then joining a cover such as a glass sheet onto the nozzle. Also included is a method as described in Japanese Patent Application Laid-open No. 154947/1986 which comprises forming an ink flow path pattern using a dissoluble resin, coating the pattern with an epoxy resin or the like, followed by curing the resin, cutting the base plate, and then removing the dissoluble resin pattern by dissolving. All these methods produce ink jet recording heads of the type in which the direction of growth of bubble and the direction of ejection of ink droplets are different (nearly perpendicular). With such a type of recording head, the distance between the ink ejection pressure generating element and the orifice is set by cutting the base plate, so that the accuracy and precision of cutting are a very important factor in controlling the distance between the ink ejection pressure generating element and the orifice. However, cutting is generally performed by a mechanical means such as a dicing saw, thus making it difficult to realize high precision and accuracy.

A method of manufacturing an ink jet recording head of the type in which the directions of bubble growth and ink droplet ejection are almost identical is described in Japanese Patent Application Laid-open No. 8658/1983 which Comprises joining together a substrate and a dry film serving as an orifice plate via another patterned dry film, and then forming orifices by photolithography. Another such method described in Japanese Patent Application Laid-open No. 264975/1987 comprises joining together a substrate having ink ejection pressure generating elements formed thereon and an orifice plate produced by electroforming via a patterned dry film. Both these methods pose difficulty in preparing thin (e.g. 20 μm or less), uniform orifice plates. Even if such a thin and uniform orifice plate was prepared, the step of joining it to the substrate having ink ejection pressure generating elements formed thereon is very difficult to perform because the orifice plate is fragile.

SUMMARY OF THE INVENTION

The present invention has been accomplished in light of the above problems, and aims to provide a method of manufacturing an ink jet recording head capable of setting a short distance between the ink ejection pressure generating element and the orifice with very high accuracy and precision as well as good reproducibility, and also capable of high grade recording.

Another object of the invention is to provide a method of manufacturing an inexpensive, highly reliable ink jet recording head through a shortened production process.

The present invention designed to attain the above-mentioned objectives is a method of manufacturing an ink jet recording head, comprising the steps of:

(1) forming an ink flow path pattern on a substrate with the use of a dissoluble resin, the substrate having ink ejection pressure generating elements thereon;

(2) forming on the ink flow path pattern a coating resin layer, which will serve as ink flow path walls, by dissolving in a solvent a coating resin containing an epoxy resin which is solid at ordinary temperatures, and then solvent-coating the solution on the ink flow path pattern;

(3) forming ink ejection outlets in the coating resin layer above the ink ejection pressure generating elements; and (4) dissolving the ink flow path pattern.

According to the invention, there can be provided a method of manufacturing an ink jet recording head capable of setting a short distance between the ink ejection pressure generating element and the orifice with very high accuracy and precision as well as good reproducibility, and also capable of high grade recording.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described in detail with reference to the drawings.

FIGS. 1, 2, 3, 4, 5 and 6 are schematic views for illustrating the fundamental embodiment of the present invention, and each of them shows an example of the construction of and the manufacturing procedure for the ink jet recording head the method of the invention pertains to.

Figure 1:
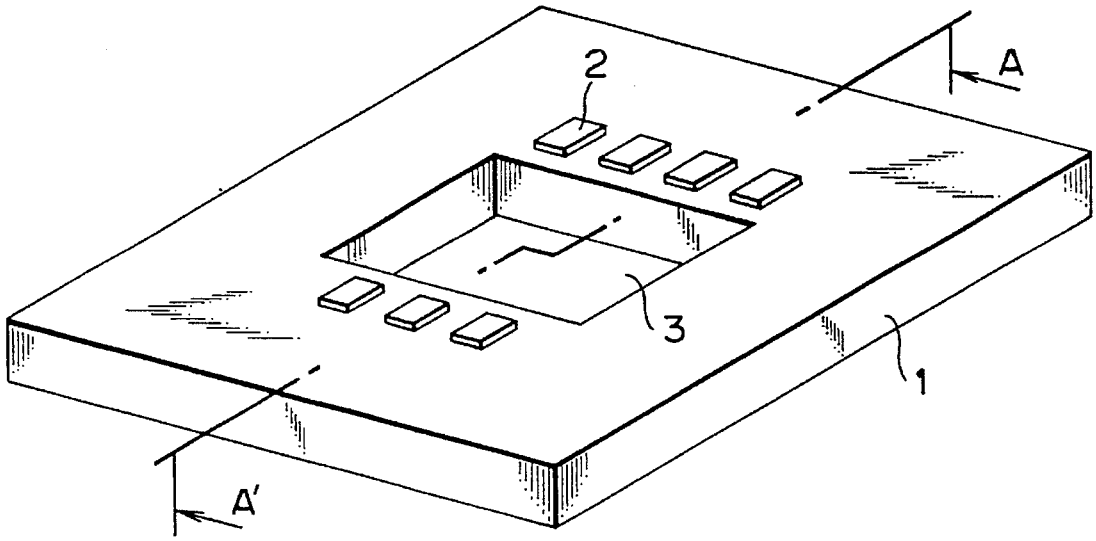
FIG. 1 is a schematic perspective view showing a substrate before the formation of an ink flow path and orifice portions.

In the instant embodiment, a base plate 1 comprising glass, ceramic, plastic or metal as shown in FIG. 1 is employed.

The base plate 1 may be of any shape or any material as long as it can function as a part of the liquid flow path constituting member and as a support for the material layers that form the ink flow path and ink ejection outlets to be described later. On the base plate 1 are disposed a desired number of ink ejection energy generating elements 2 such as electro-thermal conversion elements or piezoelectric elements. By such ink ejection energy generating elements 2, ejection energy for ejecting droplets of a recording liquid is imparted to the ink, and recording done. Incidentally, when an electro-thermal conversion element is used as the ink ejection energy generating element 2, this element heats a nearby recording liquid, thereby changing the state of the recording liquid and generating an ejection energy. When a piezoelectric element is used, on the other hand, an ejection energy is generated by its mechanical vibrations.

To these elements 2 are connected control signal input electrodes (not shown) for causing these elements to act. In an attempt to improve the durability of these ejection energy generating elements, it is customary practice to provide various functional layers such as protective layers. Needless to say, provision of such functional layers is acceptable.

FIG. 1 exemplifies a form in which an opening 3 for feeding ink is provided in the base plate beforehand, and ink is fed from behind the base plate. In forming the opening, any means can be used so long as it is capable of forming a hole in the base plate. For instance, mechanical means such as a drill, or a light energy such as laser may be employed. Alternatively, it is permissible to form a resist pattern or the like in the base plate, and chemically etch it.

It goes without saying that the ink feed inlet may be formed in the resin pattern rather than in the base plate, and provided on the same plane as the ink ejection outlets with respect to the base plate.

Figure 2:
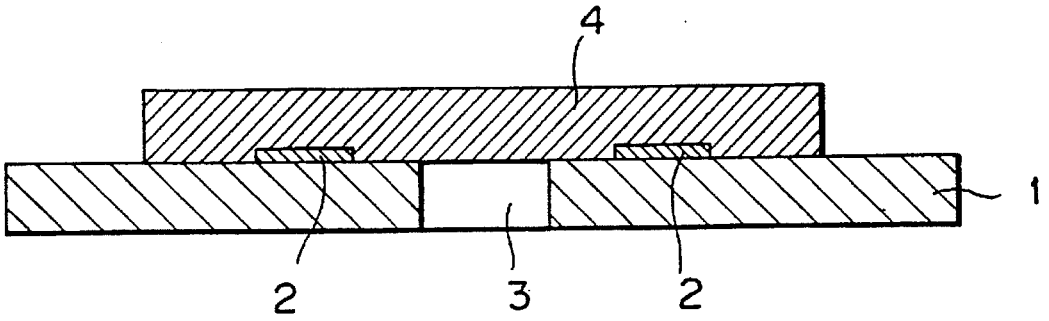
FIG. 2 is a schematic view showing the base plate having a dissoluble ink flow path pattern formed thereon.

Then, as shown in FIG. 2 (a sectional view taken on line A—A' of FIG. 1), an ink flow path pattern 4 is formed from a dissoluble resin on the base plate 1 including the ink ejection energy generating elements 2. The commonest means for forming the pattern would be one using a photosensitive material, but means such as screen printing can be employed. When the photosensitive material is used, a positive resist or a solubility-changeable negative resist can be used, since the ink flow path pattern is dissoluble.

When a base plate having an ink feed inlet therein is used, a preferred method for forming a resist layer is to dissolve the photosensitive material in a suitable solvent, coating the solution onto a film of PET or the like, followed by drying to prepare a dry film, and laminate the dry film on the base plate. For the dry film, a photodecomposable polymeric compound derived from vinylketone, such as polymethyl isopropyl ketone or polyvinylketone, can be used preferably. These compounds can be easily laminated on the ink feed inlet, because prior to exposure to light, they retain the properties of polymeric compounds (film-forming properties)

Furthermore, a filler which can be removed during a subsequent step may be disposed in the ink feed inlet 3, followed by forming a film by an ordinary method such as spin-coating or roll-coating.

Figure 3:
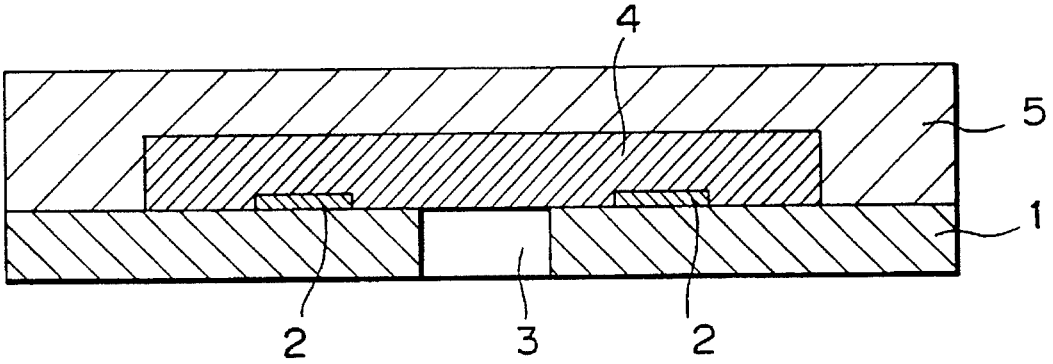
FIG. 3 is a schematic view showing the base plate having a coating resin layer formed thereon.

On the dissoluble resin material layer having the ink flow path so patterned is further formed a coating resin layer 5 by an ordinary method such as spin-coating or roll-coating, as illustrated in FIG. 3. During the step of forming the coating resin layer, characteristics, such as that of causing no deformation to the dissoluble resin pattern, are required. That is, when the coating resin layer is to be formed by dissolving the coating resin in a solvent and applying the solution onto the dissoluble resin pattern by spin-coating or roll-coating, it is necessary to select a solvent which will not melt the dissoluble resin pattern.

Next, the coating resin layer for use in the invention will be described. A preferred coating resin layer is a photosensitive one, because it enables ink ejection outlets to be formed by photolithography easily and accurately. Such a photosensitive coating resin layer is required to have a high mechanical strength as a structural material, adhesion to the base plate, ink resistance, and resolution for patterning an intricate pattern of the ink ejection outlets. We have found, upon extensive studies, that a cation-polymerized curing product of an epoxy resin possesses excellent strength, adhesion and ink resistance as a structural material, and that if the epoxy resin is solid at ordinary temperatures, it gives excellent patterning characteristics. These findings have led us to accomplish the present invention.

The cation-polymerized curing product of epoxy resin has a higher crosslinking density (high glass transition temperature [Tg]) than an ordinary curing product of an acid anhydride or amine, and thus exhibits satisfactory properties as a structural material. Moreover, the use of an epoxy resin solid at ordinary temperatures prevents the diffusion into the epoxy resin of polymerization seeds that have occurred from the cationic polymerization initiator upon exposure to light, thus ensuring highly accurate patterning and obtaining a pattern of a definite shape.

The step of forming the coating resin layer on the dissoluble resin layer is desirably carried out by dissolving in a solvent a coating resin which is solid at ordinary temperatures, and spin-coating the solution.

The use of spin-coating, a film coating technique, makes it possible to form the coating resin layer uniformly and accurately, to shorten the distance between the ink ejection pressure generating element and the orifice, a procedure difficult with conventional methods, and to achieve the ejection of droplets easily.

Here, the coating resin layer is desirably formed flat on surface. This is because (1) unevennesses present in the orifice surface would produce untoward ink reservoirs in the depressions, and (2) the flatness will facilitate processing during the formation of ink ejection outlets in the coating resin layer.

We have eagerly studied the conditions for forming the coating resin layer flat, and found that the concentration of the coating resin with respect to the solvent becomes a very important factor in terms of the flatness of the coating resin layer. Concretely, it becomes possible to flatten the surface of the coating resin layer, by dissolving the coating resin in the solvent at a concentration of 30–70 wt. %, preferably 40–60 wt. % for the spin-coating step.

If the coating resin is dissolved at a concentration of less than 30 wt.% and spin-coated, the resulting coating resin layer bears irregularities following the pattern of the dissoluble resin layer. If the coating resin is dissolved at a concentration exceeding 70 wt. % the solution itself becomes highly viscous and cannot be spin-coated; even if it could be spin-coated, the resulting film would have an unsatisfactory film thickness distribution.

When coating is performed by spin-coating, the viscosity of the coating solution needs to be 10 to 3000 cps. Too low a viscosity will run the coating solution off; too high a viscosity will result in an ununiform layer of the coating solution. Therefore, it is necessary to select a suitable solvent so that the viscosity of the solution containing the coating resin will become a desirable value at the above-mentioned concentration.

When the aforementioned negative photosensitive material is used as the coating resin, reflection from the base plate surface and scum (development residues) will occur usually. In the present invention, however, the ejection outlet pattern is formed on the ink flow path formed from the dissoluble resin, thus making the influence of reflection from the base plate negligible. Furthermore, the scum occurring during development is lifted off during the later-described step of washing away the dissoluble resin which forms the ink flow path. Hence, the scum exerts no adverse influence.

Examples of the solid epoxy resins for use in the present invention include that reaction product between bisphenol A and epichlorohydrin which has a molecular weight of about 900 or more, the reaction product between bromine-containing bisphenol A and epichlorohydrin, the reaction product between phenolic novolak or o-cresol novolak and epichlorohydrin, and the polyfunctional epoxy resins having oxycyclohexane skeleton described in the specifications of Japanese Patent Application Laying-open Nos. 161973/1985, 221121/1988 and 9216/1989 and 140219/1990. Needless to say, the epoxy resins of the present invention are not restricted to these compounds.

Of these epoxy compounds, those with an epoxy equivalent of 2,000 or less are used preferably, and those with an epoxy equivalent of 1,000 or less are used more preferably. An epoxy equivalent in excess of 2,000 may lead to a decrease in the crosslinking density during the curing reaction, thereby lowering the Tg or heat distortion temperature of the curing product, or deteriorating the adhesion or ink resistance.

Examples of the cationic photopolymerization initiator for curing the epoxy resin include aromatic iodonium salts, aromatic sulfonium salts [see J. POLYMER SCI:Symposium No. 56, 383–395 (1976)], and SP-150 and SP-170 marketed by Asahi-Denka Kogyo Kabushiki Kaisha.

The combination of these cationic photopolymerization initiators with reducing agents enables cationic polymerization to be promoted by heating (i.e. the crosslinking density can be increased compared with cationic photopolymerization done without this combination). When the cationic photopolymerization initiator is combined with a reducing agent, however, it is necessary to select such a reducing agent as to-give a redox type initiator system which does not react at ordinary temperatures, but reacts at a certain temperature or above (preferably 60° C. or above). Optimal as such a reducing agent is a copper compound, especially copper triflate (copper (II) trifluoromethanesulfonate) in view of the reactivity and the solubility in the epoxy resin. A reducing agent such as ascorbic acid is also useful. If a higher crosslinking density (higher Tg) is required because of the increased number of nozzles (high speed printing) or the use of a non-neutral ink (improved water resistance of the pigment), it is possible to raise the crosslinking density, by performing an after-step (to be described) of dipping the coating resin layer in a solution of the reducing agent and heating it, after the development step for the coating resin layer is completed.

To the above-described composition, additives may be added if desired. For instance, flexibilizers may be added to increase the elasticity of the epoxy resin, or silane coupling agents may be added to obtain a further adhesion to the base plate.

Figure 4:
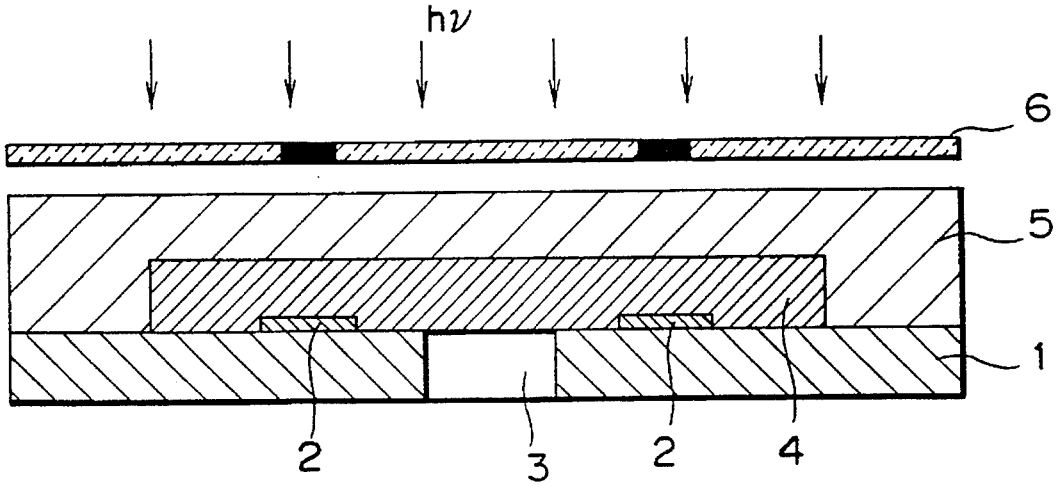
FIG. 4 is a schematic view showing the base plate having the coating resin layer pattern-exposed for ink ejection outlet formation.

Then, the photosensitive coating resin layer 5 comprising the above-described compounds is pattern-exposed through a mask 6 as illustrated in FIG. 4. The photosensitive coating resin layer 5 of the instant embodiment is of a negative type designed to shield the portions, which will constitute ink ejection outlets, with the mask (of course, it also shields the portions which will be electrically connected; not shown).

The light for pattern exposure may be selected from ultraviolet rays, deep-UV radiation, electron rays, and X-rays in conformity with the photosensitivity region of the cationic photopolymerization initiator used.

All of the above-mentioned steps are capable of register using a conventional photolithographic technique, and can attain a remarkably improved accuracy in comparison with a method in which an orifice plate is prepared separately and laminated to a base plate. The thus pattern-exposed photosensitive coating resin layer 5 may be heat-treated, if desired, to promote the reaction. Since the photosensitive coating resin layer is composed of an epoxy resin solid at ordinary temperatures as mentioned earlier, cationic polymerization seeds occurring upon pattern exposure are minimally diffused, thus enabling high patterning accuracy and shape.

Figure 5:
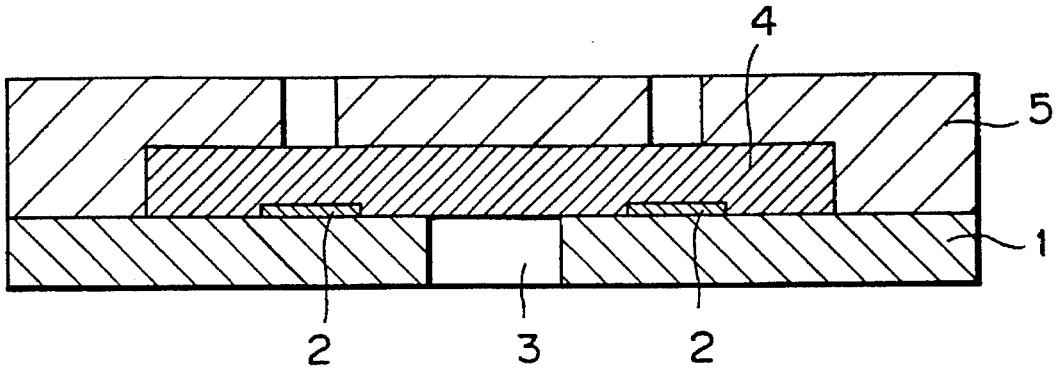
FIG. 5 is a schematic view showing the base plate having the patterned coating resin layer developed.
Figure 6:
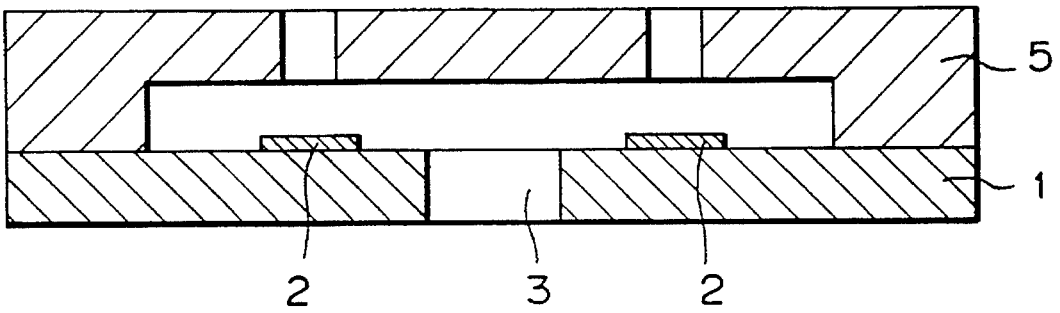
FIG. 6 is a schematic view showing the base plate having the dissoluble resin pattern dissolved.

Then, the pattern-exposed photosensitive coating resin layer 5 is developed using a suitable solvent to form ink ejection outlets as shown in FIG. 5. Simultaneously with the development of the unexposed photosensitive coating resin layer, it is possible to develop the dissoluble resin pattern 4 which will form an ink flow path. Generally, however, a plurality of heads of the same or different shapes are arranged on the base plate, and used as ink jet recording heads after being subjected to a cutting step. Therefore, as a countermeasure against swarf during cutting, the following step may be taken: Only the photosensitive coating resin layer is selectively developed as shown in FIG. 5, whereby the resin pattern 4 constituting the ink flow path is retained (the retention of the resin pattern 4 within the liquid chamber keeps swarf produced during cutting from entering the liquid chamber), and the resin pattern 4 is developed after the cutting step (FIG. 6). Furthermore, scum (development residues) occurring during the development of the photosensitive coating resin layer 5 is also dissolved together with the dissoluble resin layer, thus leaving no residues within the nozzle.

In case the crosslinking density needs to be raised as aforementioned, the photosensitive coating resin layer 5 having the ink flow path and the ink ejection outlets formed therein is then dipped in a solution containing a reducing agent, and heated for post-curing. This step further raises the crosslinking density of the photosensitive coating resin layer 5, making the adhesion to the base plate and the fastness to ink very satisfactory. Of course, this step of dipping in the copper ion-containing solution, followed by heating, may be carried out immediately after the photosensitive coating resin layer 5 is pattern-exposed and developed to form the ink ejection outlets. Afterwards, the dissoluble resin pattern 4 may be dissolved. The step of dipping and heating may be performed by either heating while dipping, or heating after dipping.

Such a reducing agent may be any substance having a reducing activity, but a compound containing copper ions, such as copper triflate, copper acetate or copper benzoate, is particularly effective. Of these compounds, copper triflate, in particular, is very effective. In addition to those compounds, ascorbic acid is also useful.

Figure 7:
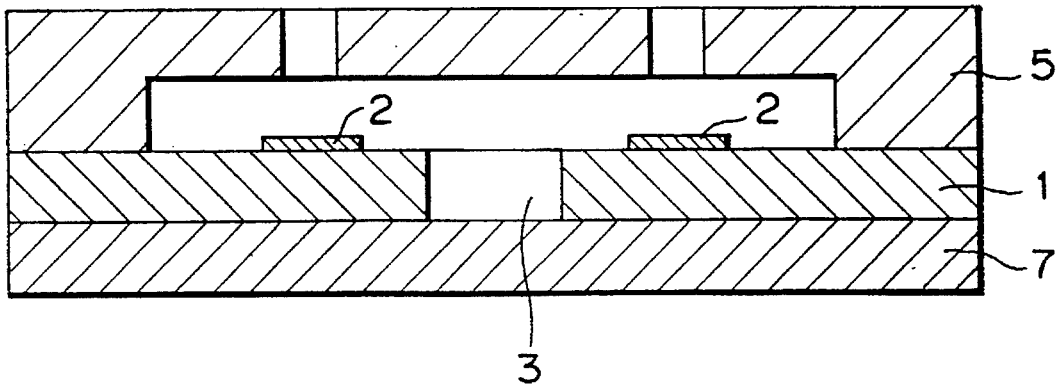
FIG. 7 is a schematic view showing the base plate having an ink feeding member mounted thereto.

The base plate having the ink flow path and the ink ejection outlets thus formed thereon is provided with a member 7 for feeding ink and an electrical connection (not shown) for driving the ink ejection pressure generating elements to complete an ink jet recording head (FIG. 7).

In the instant embodiment, the ink ejection outlets are formed by photolithography, but the present invention is not restricted to it; the ink ejection outlets can be formed by dry etching with oxygen plasma or excimer laser if the mask is changed. If excimer laser or dry etching with oxygen plasma is used to form the ink ejection outlets, the base plate is protected by the resin pattern and is unlikely to be damaged by laser or plasma, thus making it possible to provide a highly accurate and reliable head. If dry etching or excimer laser is used for the formation of the ink ejection outlets, moreover, the coating resin layer may be a photosensitive or thermosetting one.

The present invention is effective for a full-line type recording head capable of recording onto the whole width of a recording paper at the same time, and for a color recording head integrated with the recording head or having a plurality of the recording heads combined.

Also, the recording head according to the present invention is applied preferably to solid ink which liquefies at more than a certain temperature.

Examples of the present invention will be described below.

EXAMPLE 1

An ink jet recording head was produced in accordance with the aforementioned procedure shown in FIGS. 1, 2, 3, 4, 5, 6 and 7.

A blast mask was placed on a silicone base plate 1 having electro-thermal converting elements 2 (heaters composed of the material $HfB_2$) as ink ejection energy generating elements formed thereon. A through-hole 3 for feeding ink was formed by sand blasting (FIG. 1).

Then, a dry film prepared by coating polymethyl isopropenyl ketone (ODUR-1010, Tokyo Oka Kogyo Kabushiki Kaisha) onto PET, followed by drying, was transferred as a dissoluble resin layer onto the base plate. The ODUR-1010 was used in a concentrated form, because it has a low viscosity and cannot be formed into a thick film.

After this system was prebaked for 20 minutes at 120° C. it was pattern-exposed using the mask aligner PLA520 made by Canon Inc. (Cold Mirror CM290) for ink flow path formation. The exposure lasted for 1.5 minutes, and development was carried out using methyl isobutyl ketone/xylene=2/1, and rinsing using xylene. A pattern 4 formed from the dissoluble resin was intended to secure ink flow paths between the ink feeding port 3 and the electro-thermal converting elements 2 (FIG. 2). The thickness of the resist after development was 10 μm.

Then, a resin composition as shown in Table 1 was dissolved in a methyl isobutyl ketone/xylene solvent mixture at a concentration of 50 wt. % and the solution was spin-coated to form a photosensitive coating resin layer 5 (the film thickness on the pattern 4:10 μm, FIG. 3).

Thereafter, pattern-exposure for ink ejection outlet formation was performed using PLA520 (CM250). The exposure lasted 10 seconds, and after-baking was performed for 30 minutes at 60° C.

Methyl isobutyl ketone was used for development to form ink ejection Outlets. In this Example, a ø25 μm ejection outlet pattern was formed.

Under the above-mentioned conditions, the ink flow path pattern 4 was not completely developed, but remained.

Normally, a plurality of heads of the same or different shapes are arranged on base plate 1, so that the base plate is cut by means of a dicer or the like at the above stage to obtain respective ink jet recording heads. Here in this Example, however, the ink flow path pattern 4 remains as mentioned above, thus making it possible to prevent dust produced during cutting from entering the head. The so obtained ink jet recording head was exposed for 2 minutes using PLA520 (CM290), and dipped in methyl isobutyl ketone while under an ultrasonic wave, to melt the remaining ink flow path pattern 4 (FIG. 6).

Then, the ink jet recording head was heated for 1 hour at 150° C. to cure the photosensitive coating material layer 5 completely.

Finally, an ink feeding member 7 was bonded to the ink feeding port to complete an ink jet recording head.

The so prepared ink jet recording head was mounted to a recording apparatus, and recording was performed using an ink comprising demineralized water/diethylene glycol/isopropyl alcohol/lithium acetate/black dye Food Black 2=79.4/15/3/0.1/2.5. Stable printing was possible, and the resulting prints were of a high grade.

EXAMPLE 2

Evaluations were made likewise, however with the composition of the photosensitive coating resin layer of Example 1 being changed as shown in Table 2. In this Example, the mechanical strength of the nozzle constituent (a curing product of the photosensitive coating resin), its adhesion to the base plate, and so forth were improved further using a combination of a cationic photopolymerization initiator and a reducing agent. The steps until the formation of the photosensitive coating resin layer 5 were performed in the same manner as in Example 1. The pattern-exposure for ink ejection outlet formation was carried out for 5 seconds using PLA520 (CM250), and after-baking for 10 minutes at 60° C. Under these conditions, the cationic photopolymerization initiator and the reducing agent (copper triflate) do not substantially react, thus enabling patterning by light.

After development, cutting, and washing-out of the ink flow path 4 were effected in the same manner as in Example 1, baking was done for 1 hour at 150° C. At this stage, the cationic photopolymerization initiator and the copper triflate reacted, promoting the cationic polymerization of the epoxy resin. The thus obtained curing product of the epoxy resin had a higher crosslinking density than the one cured only by light, and was better in mechanical strength, adhesion to the base plate, and ink resistance than the latter. The so prepared ink jet recording head was mounted to a recording apparatus, and recording was performed using an ink comprising demineralized water/diethylene glycol/isopropyl alcohol/lithium acetate/black dye Food Black 2=79.4/15/3/0.1/2.5. Stable printing was possible, and the resulting prints were of a high grade.

After the above ink jet recording head was stored for 3 months at 60° C. with that ink being filled therein, printing was done again. Prints of the same grade as those before the storage test were obtained.

EXAMPLE 3

The ink jet recording head of Example 1 was subjected to post-steps of dipping it in a solution containing a reducing agent and heating it, whereafter evaluations were made likewise.

After the step of washing out the ink flow path 4 in Example 1, the ink jet recording head was dipped for 30 minutes in a 2 wt. % ethanol solution of copper triflate while under an ultrasonic wave, and then it was dried. After being heat-treated for 2 hours at 150° C., it was washed with pure water. Then, an ink feeding member 7 was bonded to the ink feeding port in the same way as in Example 1 to complete an ink jet recording head.

The so prepared ink jet recording head was mounted to a recording apparatus, and recording was performed as in Example 1 using an ink comprising demineralized water/diethylene glycol/isopropyl alcohol/lithium acetate/black dye Food Black 2= 79.4/15/3/0.1/2.5. Stable printing was possible, and the resulting prints were of a high grade.

To confirm the improvement of the crosslinking density due to the dipping in copper ions, the following experiments were conducted. A composition as shown in Table 1 was formed to a thickness of 10 μm on a capton film, and subjected to photosetting. Then, this laminate was either dipped in an ethanol solution containing copper ions, and heat-treated to prepare a sample (a); or dipped in a pure ethanol solution containing no copper ions, and heat-treated to prepare a sample (b). The glass transition points (Tg) of these samples were measured by dynamic viscoelastic evaluation. The sample (a) was found to have a Tg of 240° C., and the sample (b), that of 200° C. As evident from these results, the post-treatment with copper ions improved the crosslinking density, and enables a highly reliable ink jet recording head to be prepared.

TABLE 1

| | | |
|---|---|---|
| Epoxy resin | o-cresol novolak type epoxy resin (Epicoat 180H65, Yuka Shell) | 100 parts |
| Cationic photopolymerization initiator | 4,4'-di-t-butylphenoliodonium hexafluoroantimonate | 1 part |
| Silane coupling agent | A-187, Nihon Yuniker | 10 parts |

TABLE 2

| | | |
|---|---|---|
| Epoxy resin | Polyfunctional epoxy resin with oxycyclohexane skeleton (EHPE-3150, Daicel Chemical) | 100 parts |
| Cationic photopolymerization initiator | 4,4'-di-t-butylphenoliodonium hexafluoroantimonate | 0.5 part |
| Reducing agent | Copper triflate | 0.5 part |
| Silane coupling agent | A-187, Nihon Yuniker | 5 parts |

The above-described present invention is capable of strictly controlling the distances between, and the positional accuracy of, the ink ejection pressure generating elements and the orifices. Hence, it brings the effect that an ink jet recording head with stable ejection properties and high reliability can be produced by a simple method.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. A method of manufacturing an ink jet recording head, comprising the steps of:

(1) forming an ink flow path pattern on a substrate with the use of a dissoluble resin, the substrate having ink ejection pressure generating elements thereon;

(2) forming on the ink flow path pattern a coating resin layer, which will serve as ink flow path walls, by dissolving in a solvent a coating resin containing an epoxy resin which is solid at ordinary temperatures, and then solvent-coating the solution on the ink flow path pattern;

(3) forming ink ejection outlets in the coating resin layer above the ink ejection pressure generating elements; and (4) dissolving the ink flow path pattern.

2. A method of manufacturing an ink jet recording head as claimed in claim 1, wherein the coating resin is a photosensitive resin and contains a cationic photopolymerization initiator.

3. A method of manufacturing an ink jet recording head as claimed in claim 2, wherein the coating resin contains a reducing agent.

4. A method of manufacturing an ink jet recording head as claimed in claim 2, wherein the cationic photopolymerization initiator is an aromatic iodonium salt.

5. A method of manufacturing an ink jet recording head as claimed in claim 3, wherein the reducing agent is copper triflate.

6. A method of manufacturing an ink jet recording head as claimed in claim 1, wherein the epoxy equivalent of the epoxy resin is 2000 or less.

7. A method of manufacturing an ink jet recording head as claimed in claim 1, further including a step of dipping the coating resin layer in a solution containing a reducing agent and heating the coating resin layer, after performing the step of dissolving the ink flow path pattern.

8. A method of manufacturing an ink jet recording head as claimed in claim 7, wherein the reducing agent contains copper ions.

9. A method of manufacturing an ink jet recording head as claimed in claim 7, wherein the reducing agent contains copper triflate.

10. A method of manufacturing an ink jet recording head as claimed in claim 2, wherein the ink ejection outlets are formed by photolithography.

11. A method of manufacturing an ink jet recording head as claimed in claim 1, wherein the ink ejection outlets are formed by dry etching with oxygen plasma.

12. A method of manufacturing an ink jet recording head as claimed in claim 1, wherein the ink ejection outlets are formed by an excimer laser.

13. A method of manufacturing an ink jet recording head as claimed in claim 1, wherein the concentration of the coating resin dissolved in the solvent is 30– 70 wt. %.

14. A method of manufacturing an ink jet recording head as claimed in claim 13, wherein the concentration of the coating resin dissolved in the solvent is 40–60 wt. %.

15. A method of manufacturing an ink jet recording head as in claim 11, wherein the coating resin comprises a thermo-setting resin.

16. A method of manufacturing an ink jet recording head as in claim 13, wherein the coating resin comprises a thermoplastic resin.

17. A method of manufacturing an ink jet recording head, comprising the steps of:

preparing a substrate having a plurality of ink ejection pressure generating elements thereon;

forming an ink flow path pattern on said substrate using a dissoluble resin;

forming on the ink flow path pattern a coating resin layer for forming a plurality of ink flow path walls, by dissolving in a solvent a coating resin which is solid at ordinary temperatures, and then spin-coating the solution on the ink flow path pattern;

forming a plurality of ink ejection outlets in the coating resin layer above the ink ejection pressure generating elements; and dissolving the ink flow path pattern, wherein a concentration of the coating resin dissolved in the solvent is 30–70 wt. %.

18. A method of manufacturing an ink jet recording head as claimed in claim 17, wherein the coating resin comprises a photosensitive resin and contains a cationic photopolymerization initiator.

19. A method of manufacturing an ink jet recording head as claimed in claim 18, wherein the coating resin includes a reducing agent.

20. A method of manufacturing an ink jet recording head as claimed in claim 18, wherein the cationic photopolymerization initiator is an aromatic iodonium salt.

21. A method of manufacturing an ink jet recording head as claimed in claim 19, wherein the reducing agent is copper triflate.

22. A method of manufacturing an ink jet recording head as in claim 17, wherein the coating resin includes an epoxy resin.

23. A method of manufacturing an ink jet recording head as claimed in claim 22, wherein the epoxy equivalent of the epoxy resin is not more than 2000.

24. A method of manufacturing an ink jet recording head as in claim 17, further comprising the steps of:

dipping the coating resin layer in a solution containing a reducing agent; and heating the coating resin layer, after performing the step of dissolving the ink flow path pattern.

25. A method of manufacturing an ink jet recording head as in claim 24, wherein the reducing agent includes copper ions.

26. A method of manufacturing an ink jet recording head as in claim 24, wherein the reducing agent includes copper triflate.

27. A method of manufacturing an ink jet recording head as in claim 18, wherein the ink ejection outlets are formed by photolithography.

28. A method of manufacturing an ink jet recording head as in claim 17, wherein the ink ejection outlets are formed by dry etching with oxygen plasma.

29. A method of manufacturing an ink jet recording head as in claim 17, wherein the ink ejection outlets are formed by an excimer laser.

30. A method of manufacturing an ink jet recording head as in claim 17, wherein the concentration of the coating resin dissolved in the solvent is 40–60 wt. %.

31. A method of manufacturing an ink jet recording head as in claim 28, wherein the coating resin comprises a thermosetting resin.

32. A method of manufacturing an ink jet recording head having ink ejection outlets ejecting ink and ink ejection pressure generating elements generating pressure for ejecting ink, distance from said ink ejection outlet to said ink ejection pressure generating element being 20 μm or less, the method comprises the steps of:

preparing a substrate having a plurality of ink ejection pressure generating elements thereon;

forming an ink flow path pattern on said substrate using a dissoluble resin;

forming on the ink flow path pattern a coating resin layer for forming a plurality of ink flow path walls, by dissolving in a solvent a coating resin which is solid at ordinary temperatures, and then spin-coating the solution on the ink flow path pattern;

forming a plurality of ink ejection outlets in the coating resin layer above the ink ejection pressure generating elements; and dissolving the ink flow path pattern, wherein a concentration of the coating resin dissolved in the solvent is 30–70 wt.

33. A method of manufacturing an ink jet recording head as in claim 32, wherein the coating resin comprises a photosensitive resin and contains a cationic photopolymerization initiator.

34. A method of manufacturing an ink jet recording head as in claim 33, wherein the coating resin includes a reducing agent.

35. A method of manufacturing an ink jet recording head as in claim 33, wherein the cationic photopolymerization initiator is an aromatic iodonium salt.

36. A method of manufacturing an ink jet recording head as in claim 34, wherein the reducing agent is copper triflate.

37. A method of manufacturing an ink jet recording head as in claim 32, wherein the coating resin includes an epoxy resin.

38. A method of manufacturing an ink jet recording head as claimed in claim 37, wherein the epoxy equivalent of the epoxy resin is not more than 2000.

39. A method of manufacturing an ink jet recording head as in claim 32, further comprising the steps of:

dipping the coating resin layer in a solution containing a reducing agent; and heating the coating resin layer, after performing the step of dissolving the ink flow path pattern.

40. A method of manufacturing an ink jet recording head as in claim 39, wherein the reducing agent includes copper ions.

41. A method of manufacturing an ink jet recording head as in claim 39, wherein the reducing agent includes copper triflate.

42. A method of manufacturing an ink jet recording head as in claim 33, wherein the ink ejection outlets are formed by photolithography.

43. A method of manufacturing an ink jet recording head as in claim 32, wherein the ink ejection outlets are formed by dry etching with oxygen plasma.

44. A method of manufacturing an ink jet recording head as in claim 32, wherein the ink ejection outlets are formed by an excimer laser.

45. A method of manufacturing an ink jet recording head as in claim 32, wherein the concentration of the coating resin dissolved in the solvent is 40–60 wt. %.

46. A method of manufacturing an ink jet recording head as in claim 43, wherein the coating resin comprises a thermosetting resin.

* * * * *

UNITED STATES PATENT AND TRADEMARK OFFICE

CERTIFICATE OF CORRECTION

PATENT NO. : 5,478,606

DATED : December 26, 1995

INVENTORS : NORIO OHKUMA, ET AL.

It is certified that error appears in the above-identified patent and that said Letters Patent is hereby corrected as shown below:

COLUMN 1

Line 65, "Com-" should read --com---.

COLUMN 3

Line 9, "thereto;" should should --thereto.--

COLUMN 5

Line 12, "70 wt.%" should read --70 wt.%,--.

Line 13, "even" should read --and even--.

UNITED STATES PATENT AND TRADEMARK OFFICE

CERTIFICATE OF CORRECTION

PATENT NO. : 5,478,606

DATED : December 26, 1995

INVENTOR(S) : NORIO OHKUMA, ET AL.

It is certified that error appears in the above-identified patent and that said Letters Patent is hereby corrected as shown below:

COLUMN 6

Line 1, "to-give" should read --to give--.

COLUMN 8

Line 22, "Outlets." should read --outlets.--

COLUMN 10

Line 20, "be" should read --be seen--.

UNITED STATES PATENT AND TRADEMARK OFFICE

CERTIFICATE OF CORRECTION

PATENT NO. : 5,478,606

DATED : December 26, 1995

INVENTOR(S) : NORIO OHKUMA, ET AL.

It is certified that error appears in the above-identified patent and that said Letters Patent is hereby corrected as shown below:

COLUMN 12

Line 21, "distance" should read --a distance--.
Line 23 , "comprises" should read --comprising--.
Line 39, "30-70 wt." should read --30-70 wt%.--

Signed and Sealed this

Fourth Day of June, 1996

Bruce Lehman

*Attest:*

BRUCE LEHMAN

*Attesting Officer*

*Commissioner of Patents and Trademarks*